US005081899A

United States Patent [19]

Hou et al.

[11] Patent Number: 5,081,899

[45] Date of Patent: Jan. 21, 1992

[54] RECIPROCATING ORNAMENTAL DISPLAY ASSEMBLY

[75] Inventors: Jack Hou, P.O. Box 78-5; I-Pin Feng, both of Taipei, Taiwan

[73] Assignee: Jack Hou, Taipei, Taiwan

[21] Appl. No.: 581,313

[22] Filed: Sep. 12, 1990

[51] Int. Cl.[5] ..... G10F 1/06

[52] U.S. Cl. ..... 84/95.2

[58] Field of Search ..... 84/94.1, 94.2, 95.1, 84/95.2

[56] References Cited

U.S. PATENT DOCUMENTS 1,876,753 9/1932 Reuge ..... 84/95.2

4,708,689 11/1987 Hou ..... 84/95.2

FOREIGN PATENT DOCUMENTS 291234 9/1953 Switzerland ..... 84/94.2

*Primary Examiner*—Brian W. Brown

*Attorney, Agent, or Firm*—Bacon & Thomas

[57] ABSTRACT

An ornamental display assembly is disclosed wherein ornamental objects, are reciprocated in a generally vertical path relative to a stationary base. A wind-up music box, which supplies music to entertain the user as the ornamental objects undergo their reciprocating motion, also provides the sole power source to cause such movement. A music box mechanism includes a rotating drum provided with a rotating output shaft. A crank mechanism having an eccentric cam member is attached to the output shaft such that it rotates with the music box drum. The eccentric cam engages a follower member such that the follower member undergoes reciprocating movement as the drum rotates. A rocker arm, pivotally supported on a base member, is caused to oscillate about its pivot axis by the motion of the follower member. A second follower member is operatively associated with the opposite end of the rocker arm on the opposite side of the pivot axis from the first follower member. Thus, as the first follower member reciprocates, the rocker arm causes the second follower member to also reciprocate, but in the opposite direction.

9 Claims, 2 Drawing Sheets

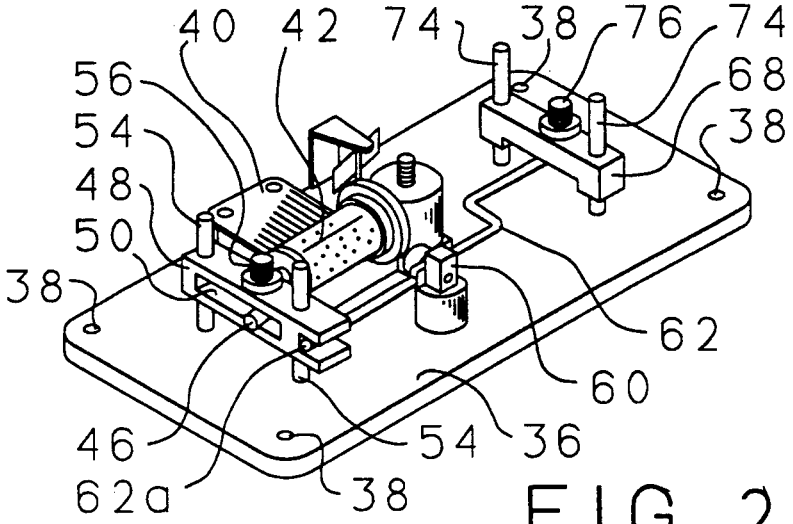
FIG. 2
FIG. 3
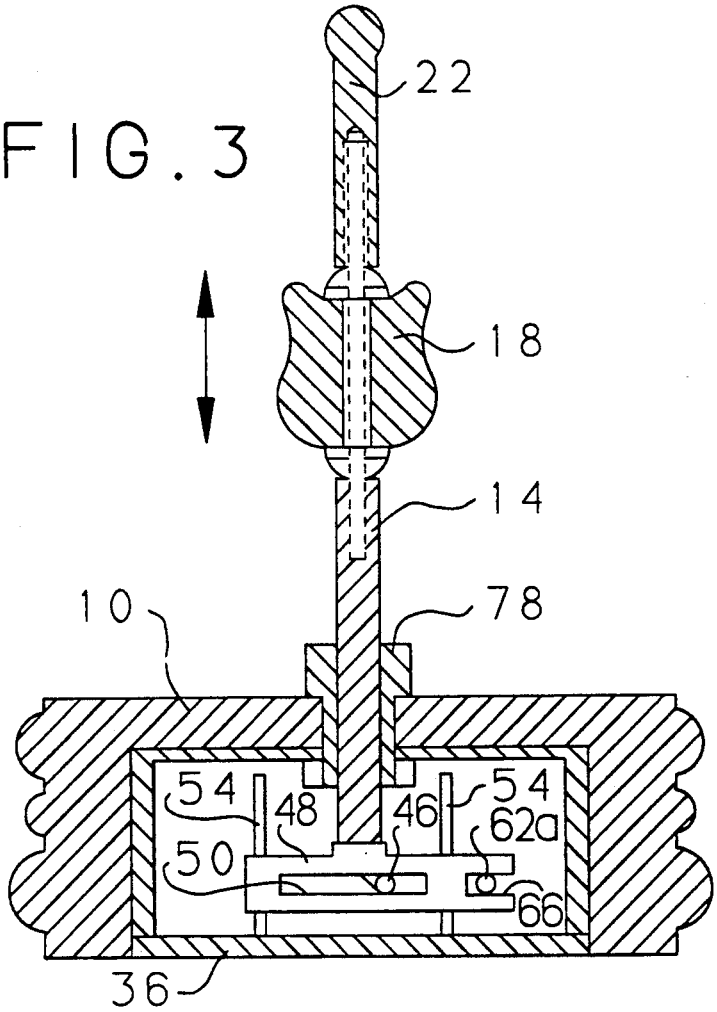

RECIPROCATING ORNAMENTAL DISPLAY ASSEMBLY

BACKGROUND OF THE INVENTION

The present invention relates to ornamental display assemblies, more particularly such assemblies wherein a plurality of ornamental objects undergo reciprocating motion.

Ornamental display assemblies having movable elements are generally well-known in the art. Such assemblies may assume the configuration of a carousel which rotates about a generally vertical axis while the horses of the carousel undergo vertical reciprocating motions. It is also known to include a music generating mechanism, such as a music box, to provide musical background while the assembly performs its motions.

It is also known to provide a stationary base on which one or more ornamental objects are mounted and to provide an appropriate power drive source to cause the objects to move in different directions.

While such devices have provided untold hours of amusement for users, their drive mechanisms are often complex. Such complex drive mechanisms are costly to manufacture and are inherently subject to numerous mechanical break downs.

SUMMARY OF THE INVENTION

An ornamental display assembly is disclosed wherein a plurality of ornamental objects, such as horses, are caused to reciprocate in a generally vertical path relative to a stationary base. A wind-up music box, which supplies music to entertain the user as the ornamental objects undergo their reciprocating motion, also provides the sole power source to cause such movement.

As is well-known in the art, a music box mechanism includes a rotating drum provided with a rotating output shaft. A crank mechanism having an eccentric cam member is attached to the output shaft such that it rotates with the music box drum. The eccentric cam engages a follower member such that the follower member undergoes reciprocating movement as the drum rotates. A rocker arm, pivotally supported on a base member, is caused to oscillate about its pivot axis by the motion of the follower member. A second follower member is operatively associated with the opposite end of the rocker arm on the opposite side of the pivot axis from the first follower member. Thus, as the first follower member reciprocates, the rocker arm causes the second follower member to also reciprocate, but in the opposite direction.

A housing may enclose all of the components of the device to conceal the mechanism from the user. Tappet rods are attached to each of the follower members and extend to the exterior of the housing. The ornamental objects are mounted on each of the tappet rods such that, as the music plays, the ornamental objects undergo reciprocating motion in opposite directions.

BRIEF DESCRIPTION OF THE FIGURES

FIG. 2 is a perspective view of the actuating mechanism of the assembly shown in FIG. 1.

FIG. 3 is a cross-sectional view of the assembly illustrated in FIG. 1.

DETAILED DESCRIPTION OF THE PREFERRED EMBODIMENT

Figure 1:
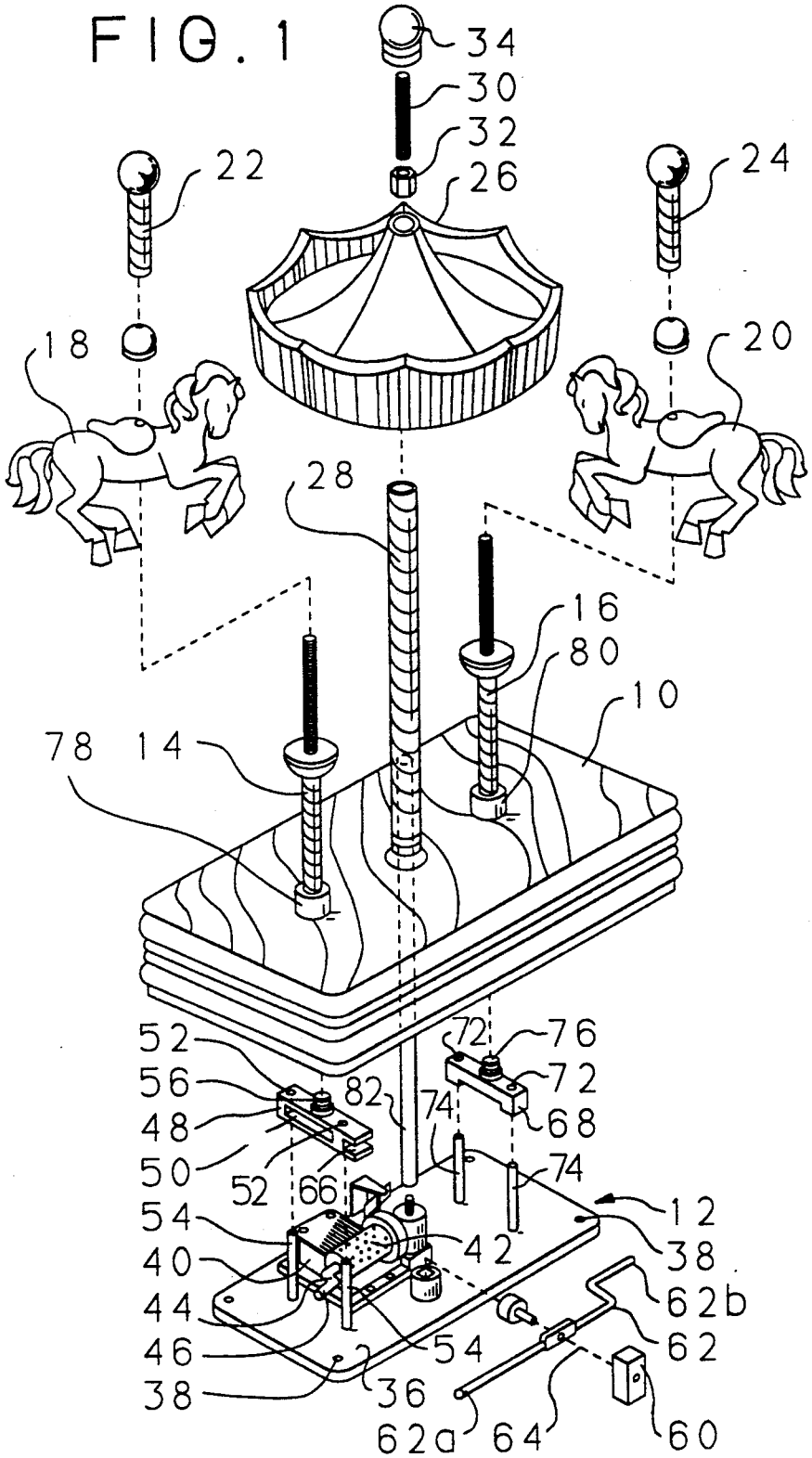
FIG. 1 is an exploded, perspective view of the ornamental display assembly according to the present invention.

The display assembly according to the present invention comprises a housing 10, which may have a decorative exterior finish, enclosing an actuating mechanism, indicated generally at 12. Tappet rods 14 and 16, which extend exteriorly of the housing 10, are reciprocated by the actuating mechanism 12 as will be described in more detail hereinafter. Ornamental objects 18 and 20, which are fixedly attached to the tappet rods 14 and 16 also reciprocate along a generally vertical path of travel in opposite directions. Ornamental objects 18 and 20 are attached to the upper portions of tappet rods 14 and 16 via decorative nuts 22 and 24, respectively. Other decorative attachments may be attached to housing 10, such as canopy 26 supported on pole 28 by threaded stud 30, 32 and a decorative cap nut 34.

Actuating mechanism 12 comprises a base member 36 which may be attached to housing 10 via screws or the like inserted through holes 38. A wind-up music box mechanism 40, having a known construction, is fixedly attached to base member 36. As is well-known in the art, music box mechanism 40 has a rotating drum 42 which has a rotating output shaft 44. A crank mechanism is operatively associated with the output shaft 44 such that the crank mechanism has a cam element 46 eccentrically located with respect to the output shaft 44. Thus, as music box drum 42 and output shaft 44 rotate about a rotational axis, the cam element 46 moves in a circle about this axis.

First follower member 48 defines a first slot 50 which slidably accommodates the cam element 46. Follower member 48 also defines a pair of openings 52 which slidably accommodate guide rods 54. Thus, the circular movement of cam element 46 causes follower member 48 to undergo reciprocating movement along the guide rods 54. Such movement takes place in a plane extending generally perpendicular to the rotational axis of the output shaft 44 and the drum 42. A threaded portion 56 is attached to follower member 48 and is threadingly engaged to a bottom portion of tappet rod 14 such that the reciprocating movement of the follower member is imparted to the tappet rod 14 and, consequently, to the ornamental object 18.

Support block 60 is mounted on the base 36 and pivotally supports the rocker arm 62 so as to oscillate about axis 64. Rocker arm 62 may have a generally "Z" shaped configuration, as illustrated in FIGS. 1 and 2, such that a first end **62*a* is slidably accommodated in slot 66, defined by follower member 48**.

A second end **62*b*, located on the opposite side of the pivot axis 64, bears against a second follower member 68. Follower member 68 defines holes 72 which slidably accommodate guide rods 74 attached to base member 36. Second follower member 68 has threaded member 76 attached thereto, which is threadingly engaged to the bottom of tappet rod 16**.

As can be readily seen, the reciprocating movement of first follower member 48 imparts an oscillating movement to the rocker arm 62 about pivot axis 64. The oscillating motion of the rocker arm 62, in turn, imparts a reciprocating motion to second follower member 68 due to the contact with end **62*b* of the rocker arm. It should be evident that the directions of travel of the follower members 48 and 68 are always in opposite directions and both are driven solely by the music box mechanism 40. The motion of the respective follower members 48 and 68 are imparted to the tappet rods 14 and 16 and, consequently, the ornamental objects 18 and 20. Thus, as the music box provides musical accompaniment, the ornamental objects reciprocate in opposite directions with respect to the housing 10**.

Tappet rods 14 and 16 may be slidably supported through the housing 10 via bushings 78 and 80, respectively. A support pole 82 may extend from the base 36 upwardly through the center of hollow pole 28 to provide additional rigidity to the canopy structure.

The foregoing description is provided for illustrative purposes only and should not be construed as in any limiting this invention, the scope of which is defined solely by the appended claims.

We claim:

1. An ornamental display assembly comprising:

a) a base member;

b) a music box mechanism having a rotating power output shaft;

c) a crank mechanism operatively associated with the rotating output shaft, the crank mechanism having a cam element located eccentrically with respect to the rotating output shaft;

d) a first follower member operatively associated with the cam element such that rotation of the output shaft causes reciprocating motion of the first follower member;

e) support means located on the base member;

f) a rocker arm having first and second ends pivotally attached to the support means between its first and second ends having the first end operatively associated with the first follower member such that reciprocating motion of the first follower member causes oscillating motion of the rocker arm about a pivot axis;

g) a second follower member operatively associated with the second end of the rocker arm such that the oscillation of the lever arm causes reciprocating motion of the second follower member; and, h) at least one ornamental object operatively connected to each follower member so as to undergo reciprocating movement with the follower members.

2. The ornamental display assembly of claim 1 further comprising:

a) first guide means operatively associated with the first follower member to guide it in its reciprocating motion; and, b) second guide means operatively associated with the second follower member to guide it in its reciprocating motion.

3. The ornamental display assembly of claim 2 wherein the first and second guide means comprise:

a) at least one first guide rod;

b) at least one first opening defined by the first follower member so as to slidably accommodate the at least one first guide rod;

c) at least one second guide rod; and, d) at least one second opening defined by the second follower member so as to slidably accommodate the at least one second guide rod.

4. The ornamental display assembly of claim 1 wherein the first follower member defines a first slot to drivingly accommodate the cam element.

5. The ornamental display assembly of claim 4 wherein the first follower member defines a second slot to drivingly accommodate the first end of the rocker arm.

6. The ornamental display assembly of claim further comprising:

a) a pair of ornamental objects; and b) means attaching an ornamental object to each of the followers.

7. The ornamental display assembly of claim 6 wherein the attaching means comprises a tappet rod attached to a follower member and to an ornamental object.

8. The ornamental assembly of claim 7 further comprising a housing enclosing the music box mechanism, the crank mechanism, the first and second follower members, the support means and the rocker arm.

9. The ornamental assembly of claim 8 wherein the housing defines openings to slidably accommodate the tappet rods.

* * * * *